US006356734B1

(12) United States Patent
Muir

(10) Patent No.: US 6,356,734 B1
(45) Date of Patent: Mar. 12, 2002

(54) METHOD AND APPARATUS FOR APPLYING TONER RELEASE AGENT IN AN IMAGE FORMING APPARATUS

(75) Inventor: Arthur H. Muir, Irvine, CA (US)

(73) Assignee: Aetas Technology, Incorporated, Irvine, CA (US)

( * ) Notice: Subject to any disclaimer, the term of this patent is extended or adjusted under 35 U.S.C. 154(b) by 0 days.

(21) Appl. No.: 09/716,796

(22) Filed: Nov. 20, 2000

(51) Int. Cl.[7] ..... G03G 15/20
(52) U.S. Cl. ..... 399/325
(58) Field of Search ..... 399/324, 325, 399/69

(56) References Cited

U.S. PATENT DOCUMENTS 4,045,165 A * 8/1977 Nakajima et al. ..... 399/325 X
5,221,948 A * 6/1993 Dalal ..... 399/325
5,978,640 A * 11/1999 Segawa ..... 399/325 X
6,272,307 B1 * 8/2001 Ishizuka et al. ..... 399/325

FOREIGN PATENT DOCUMENTS

JP 11-65353 * 3/1999

* cited by examiner

*Primary Examiner*—Susan S. Y. Lee
(74) *Attorney, Agent, or Firm*—Sonnenschein Nath & Rosenthal

(57) ABSTRACT

An image forming apparatus for forming images on a media substrate having an electrophotographic image forming apparatus including apparatus for selectively applying a toner release agent. The apparatus includes a supply roller for applying a toner release agent onto a fuser roller or other roller. In operation, the supply roller is selectively moveable by a thermally-activated actuator such as a pair of shape memory alloy (SMA) members from a first position where the supply roller engages the fuser roller and communicates the toner release agent thereto, and a second or disengaged position where supply roller does not contact the fuser roller. A method for applying a toner release agent in an electrophotographic imaging forming apparatus, and a method for printing toner images on a substrate such that all of the toner images adhere to the substrate are also disclosed.

27 Claims, 4 Drawing Sheets

METHOD AND APPARATUS FOR APPLYING TONER RELEASE AGENT IN AN IMAGE FORMING APPARATUS

BACKGROUND OF THE INVENTION

1. Field of the Invention

This invention relates generally to image forming apparatuses such as electrophotographic copiers, printers and the like, and more particularly to novel assemblies and methods for controlling toner release agent application in such devices.

2. Background Art

In electrophotographic imaging (or xerography), it is well-known to uniformly charge a photoreceptor (e.g., a belt or a drum) to form electrostatic latent images corresponding to original images on a charge retentive surface of the photoreceptor. The selective dissipation of the charge leaves a latent charge pattern on the photoreceptor corresponding to the areas of the original images not exposed by radiation.

After the latent images are formed, toner particles are deposited on the photoreceptor to develop the electrostatic latent images. Next, the developed images are transferred by contact to a media substrate (e.g., paper, transparency, and the like). The media substrate containing the transferred image is then passed between a pressure roller and a fuser roller to permanently fuse the toner images to the substrate.

During fusing, the area of contact or deformation between the pressure roller and the fuser roller is called the "nip." The substrate is moved through the nip with the toner image contacting the fuser roller. Preferably, to promote proper fusing at least one of the pressure and fuser rollers is heated, and at least one of the rollers is coated with an elastomer such as silicone rubber or a resin such as Teflon®. Due to heat build up in the rollers, however, the toner image may adhere to the rollers instead of fusing with the substrate as desired. These "leftover" toner images may be unwittingly transferred from the rollers to a subsequent media substrate passed between the rollers, and may also be passed between the rollers.

One approach to substantially preclude "leftover" toner images has been to apply a toner release agent, such as a microscopic film of low surface energy silicone oil, on the fuser roller such that the toner release agent and the toner images are transferred to the media substrate. Thus, none of the toner images are retained by the pressure or fuser rollers.

Prior art approaches for applying the toner release agent to the fuser roller include mounting an oil roller in abutting relation to the fuser roller such that during operation oil is transferred from the oil roller to the fuser roller. Other devices utilize a system of rollers to transfer oil to the fuser roller. For example, U.S. Pat. No. 5,202,734 discloses a sump for supplying oil to a meter roller, and an oil roller in working contact with a fuser roller. The meter roller and the oil roller work in tandem to transfer oil from the sump to the fuser roller.

Prior art apparatus have several significant limitations and disadvantages. First, the continuous contact maintained between the oil roller and the fuser roller causes excessive oil buildup on the fuser roller during periods of inactivity, which results in excessive oil consumption. Excess oil on the fuser roller not only saturates the media substrate, it can also substantially reduce the working life of the fuser roller and the oil roller.

Prior art approaches to solve this problem have focused on removing excess oil by mounting a blade in working contact with the fuser roller or the pressure roller. However, this solution merely removes the unwanted oil; it does not prevent excessive oil consumption. Moreover, the blade itself causes roller wear, and the blade must be repositioned over time to compensate for wear between the oil roller and the blade. Further, the blade must also be replaced when it becomes worn.

In view of the foregoing, a need exists for a simple, low cost, low maintenance apparatus for controlling toner release agent application in an image forming apparatus.

SUMMARY OF THE DISCLOSURE

The present invention relates to a system for applying a toner release agent to a fuser roller within an image forming apparatus. The present invention utilizes a simple, low-cost, reliable thermally-activated actuator subassembly to selectively apply the toner release agent to a fusing unit in the image forming apparatus. The present invention not only conserves the toner release agent, it also increases the imaging quality and prolongs the working life of the image forming apparatus.

An image forming apparatus includes an imaging subsystem for forming images on a media substrate, such as a tone-on-tone electrophotographic imaging apparatus. The imaging subsystem includes, for example, a photoreceptor, a series of print stations operably associated with the photoreceptor to form a developed image thereon, a transfer charger operably associated with the photoreceptor, and a fuser roller.

The image forming apparatus also includes a supply roller for selectively applying the toner release agent onto the fuser roller or other roller. The supply roller is selectively moveable between a first position where the supply roller engages the fuser roller and communicates a toner release agent thereto, and a second or disengaged position where the supply roller does not contact the fuser roller. A thermally-activated actuator subassembly including, for example, a pair of shape memory alloy (SMA) members is provided for controlling engagement and disengagement between the supply roller and the fuser roller. The apparatus is configured such that when a working temperature of the image forming apparatus is at or about a critical temperature (corresponding to the binary activation temperature of the SMA members), the SMA members pull the supply roller into engagement with the fuser roller to transfer the toner release agent from the supply roller to the fuser roller. Conversely, the fuser roller and the supply roller become disengaged when the working temperature of the apparatus falls below the critical temperature.

The present invention also includes several methods. First, a method is disclosed for applying a toner release agent to an electrophotographic imaging device. Also, a method is disclosed for printing toner images on a substrate such that all of said toner images are substantially transferred from the photoreceptor to the substrate.

The present invention conserves the toner release agent by eliminating consumption during inactivity or when the working temperature of the apparatus falls below the critical temperature, eliminates the need for the oil removal blade, and provides a simple, low cost, low maintenance solution with few moving parts.

Other advantages of this invention will become apparent from the following description taken in conjunction with the accompanying drawings wherein are set forth, by way of illustration and example, certain embodiments of this invention.

BRIEF DESCRIPTION OF THE DRAWINGS

A more complete appreciation of the invention and many of the advantages thereof will be readily obtained as the same becomes better understood by reference to the detailed description when considered in connection with the accompanying drawings, wherein.

BEST MODES OF PRACTICING THE INVENTION

Figure 1:
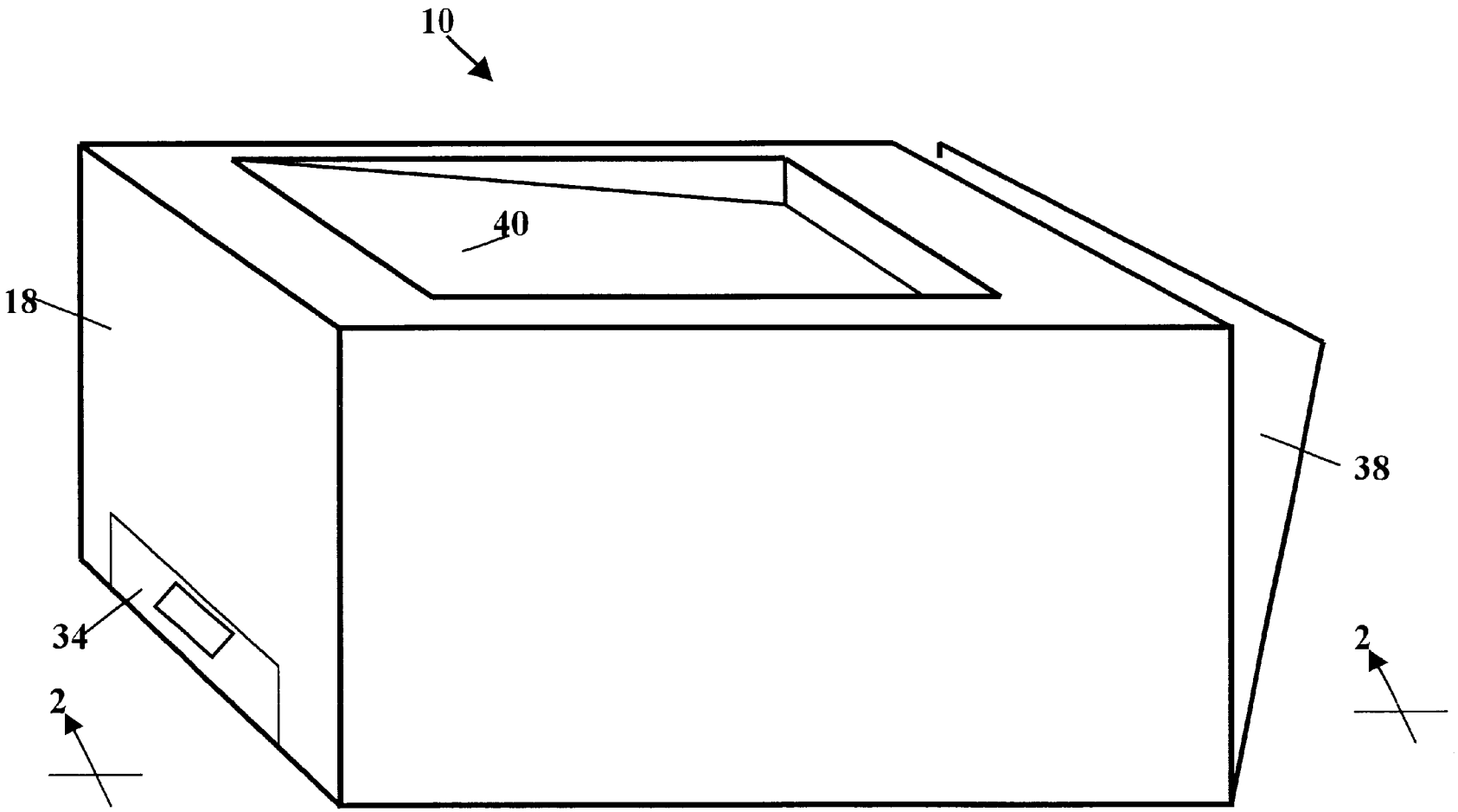
FIG. 1 is a perspective view of an image forming apparatus exemplifying the present invention.

While the present invention may be embodied in many different forms, there is shown in the drawings and discussed herein one or more specific embodiments with the understanding that the present disclosure is to be considered only as an exemplification of the principles of the invention and is not intended to limit the invention to the embodiments illustrated. For instance, the principles of the present invention are described herein in the context of an electrophotographic (EPG) imaging system as illustrated in the drawings but are equally applicable to printers and photocopiers of all types in which toner is fixed or fused to a media substrate, such paper.

Figure 2:
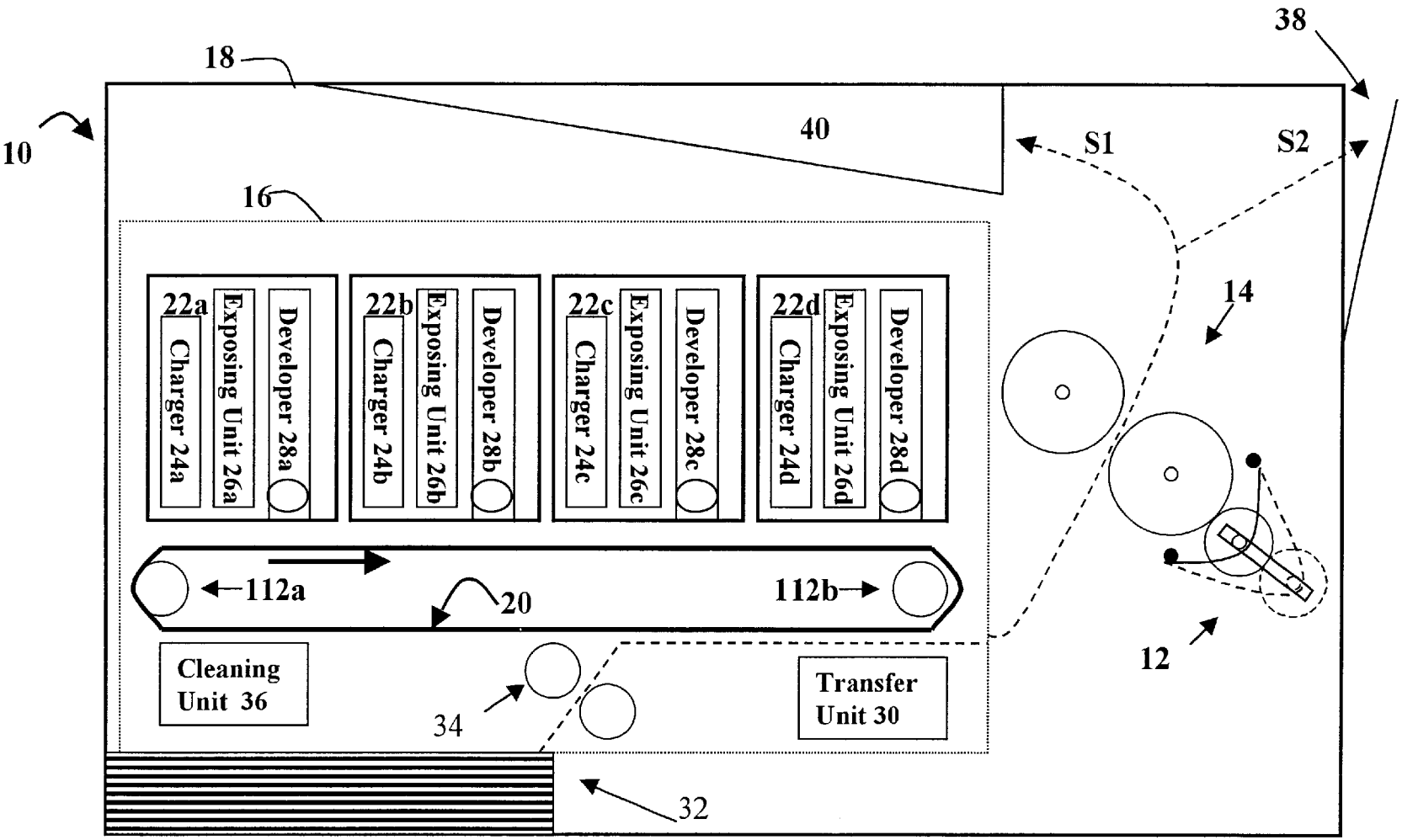
FIG. 2 is a sectional view taken along line 2—2 of FIG. 1, showing, among other things, a fusing unit 14 having its supply roller in an engaged position (the disengaged position being shown in phantom)

An exemplary image forming apparatus 10 with a toner release agent assembly 12 for applying a toner-release agent in a fusing unit 14 is illustrated in FIGS. 1 and 2. Exemplary image forming apparatus 10 includes an imaging subsystem 16 within housing 18, which generally includes elements for charging, exposing, developing, transferring, fusing, and cleaning. For a general discussion of six-step EPG imaging cycles or processes, see, for example, pages 2110 to 2116 by Robert C. Durbeck in *The Electrical Engineering Handbook,* 2nd ed., CRC Press, 1997, the entire disclosure of which is incorporated herein by reference. For a more detailed discussion of six-step EPG imaging cycles or processes, see, for example, pages 26 to 49, of *Electrophotography and Development Physics,* 2nd ed., by Lawrence B. Schein (Laplacian Press, Morgan Hill, Calif., 1996), the entire disclosure of which is also incorporated herein by reference.

In particular, exemplary EPG imaging subsystem 16 is configured to print color images with a single pass of a roller-driven photoreceptor 20. More specifically, a plurality of imaging stations, e.g., 22*a,* 22*b,* 22*c,* 22*d* are provided, with each station 22 forming a latent image and, in turn, a toner image in a respective one of the four standard colors (i.e., yellow, magenta, cyan, and black) on the photoreceptor 20. Photoreceptor 20 is schematically shown as comprising a belt-type photoreceptor. It is also contemplated that other types of photoreceptors, such as a drum-type photoreceptor may be used. As would be understood by those of ordinary skill in the art, in the case of a belt-type photoreceptor, the belt would be positioned about two or more rollers (112*a* and 112*b*): one roller serving as a drive roller and another serving as a tensioning roller. In most instances, the photoreceptor (belt or drum) is driven by a motor (not shown). As the photoreceptor rotates, each part thereof is brought into operable registration with the various components of the electrophotographic apparatus, including print stations 22*a–d,* and transfer charger 30.

Briefly, each imaging station 22*a–*22*d* may include a charging unit 24*a,* 24*b,* 24*c,* 24*d;* an exposing unit 26*a,* 26*b,* 26*c,* 26*d;* and a developing unit 28*a,* 28*b,* 28*c,* 28*d* with a toner supply (not shown). The chargers of each print station charge the image area of the photoreceptor uniformly. The charger can be an AC or DC corotron, scorotron, dicorotron, a discorotron, a pin scorotron or any other device capable of setting up a uniform electric field (preferably on the order of 500 volts magnitude) on the photoreceptor. The exposure devices of each print station selectively expose the photoreceptor to a modulated light causing the charge on the photoreceptor to dissipate wherever the light falls. Light exposure device (LED) may comprise a laser, an array of light emitting diodes or other type of coherent light source. By selectively controlling emission of light from the light exposure device a latent image is created on the photoreceptor. The developers of each print station provide a sufficient quantity of a respective toner having a charge opposite to that of the photoreceptor to develop the latent image on the photoreceptor.

Downstream from the sequential imaging stations 22 is a transferring unit 30 for transferring the toner images formed by the imaging stations 22 onto a piece of sheet material 32 such as paper from a sheet feeder 34. As shown in FIG. 2, transferring unit 30 is operably associated with the photoreceptor such that a media substrate is driven between the photoreceptor and transfer charger. The transfer charger sprays ions—having a charge opposite to that of the toner—on the back of the substrate to attract the toner onto the substrate. The fusing unit 14 fuses or fixes the transferred toner to the sheet material and is disposed within a sheet path S. A cleaning unit 36 is disposed upstream from a first one of the imaging stations 22 for cleaning residual toner and contaminants from the photoreceptor 20. Sheet material with fused images may follow either a first output sheet path $S_1$ to a first receiving tray 38 or a second output sheet path $S_2$ to a second receiving tray 40.

Figure 3:
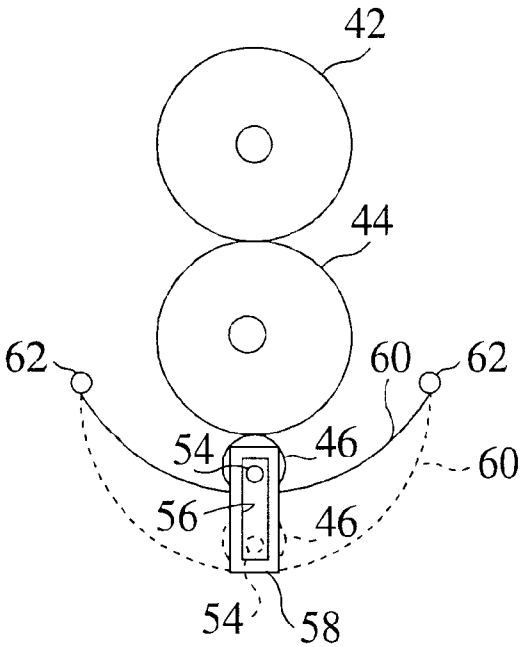
FIG. 3 is a schematic end elevational illustration of the fusing portion of an imaging apparatus exemplifying the present invention, showing the supply roller thereof in an engaged position (disengaged position shown in phantom)

FIG. 3 illustrates the fusing portion of the image forming apparatus 10—showing a conventional pressure roller 42 mounted in abutting relation to a fuser roller 44, and fuser roller 44 mounted adjacent to the toner release agent application assembly 12.

Figure 4:
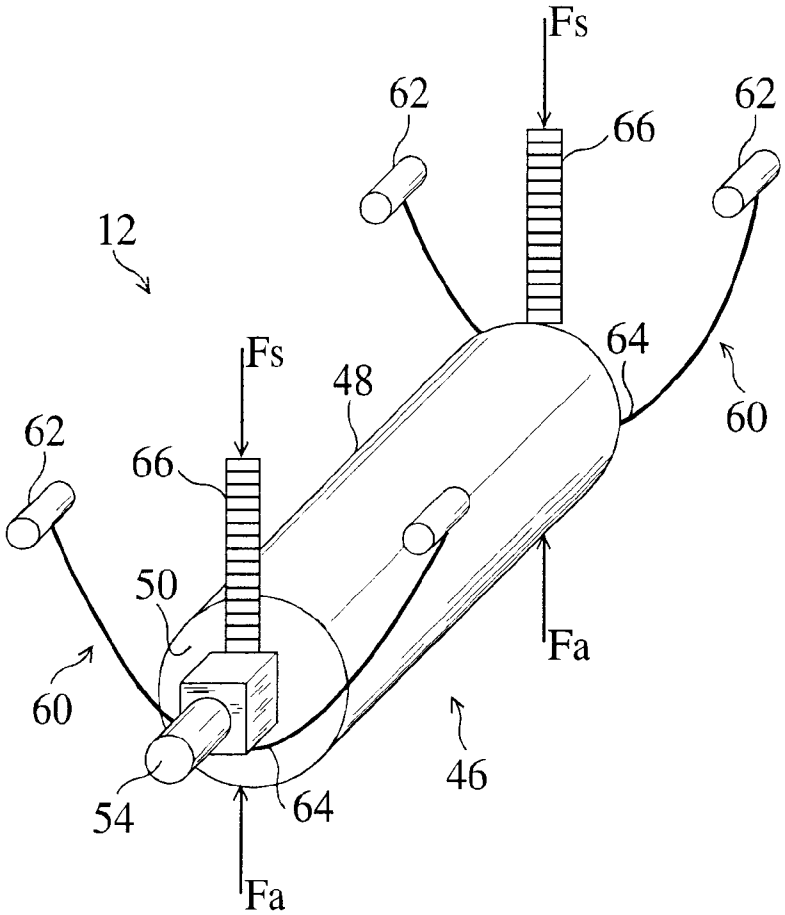
FIG. 4 is a broken away perspective view of the supply roller and one illustration of a terminally-activated actuator subassembly.

FIG. 4 shows the toner release agent application assembly 12 broken away from the rest of the image forming apparatus 10. The toner release agent application assembly 12 comprises a supply roller 46 for applying a toner release agent such as silicone oil to the fuser roller 44, and a thermally-activated actuator subassembly (described below) for selectively engaging and disengaging the supply roller 46 with the fuser roller 44.

Referring to FIG. 4, the supply roller 46, which is in working contact with the toner release agent, includes an outer surface 48 and opposed ends 50. Bushings 52 facilitate rotation of the supply roller 46 about an axial shaft 54. The shaft 54 is slidably mounted to the housing 18 between a pair of guide slots 56 (one of which is visible in FIGS. 2 and 4) respectively formed in a pair of support brackets 58 (one of which is visible in FIGS. 2 and 4). The guide slots 56 facilitate substantially linear upward and downward movement of the supply roller 46 within the housing 18 such that the supply roller 46 is selectively moveable between a first position, shown in solid lines in FIGS. 2 and 3, where the supply roller 46 engages the fuser roller 44 and communicates the toner release agent disposed on outer surface 48 thereto, and a second or disengaged position, shown in phantom lines in FIGS. 2 and 3, where the supply roller 46 does not contact the fuser roller 44 and, thus, does not transfer any toner release agent to the fuser roller 44.

The thermally-activated actuator subassembly may comprise, for example, a pair of shape memory alloy (SMA) members 60 for selectively controlling engagement between the fuser roller 44 and the supply roller 46. As shown in the illustration of FIGS. 3 and 4, opposed ends of the SMA members 60 are fixedly attached to the housing 18 at mounting pins 62, and intermediate looped portions 64 of the SMA members 60 are operably positioned beneath the bushings 52. During operation the SMA members 60 can exert upward forces $F_a$ on the supply roller 46 to operably engage the supply roller 46 with the fuser roller 44.

As shown in FIG. 4, the actuator subassembly 12 preferably includes a pair of helical springs 66, each having a first end affixed to a respective bushing 52 and a second end affixed to the housing 18. The springs 66 exert downward spring forces, $F_s$, to bias the supply roller 46 toward its disengaged position. Of course, other mechanisms for exerting force $F_s$ are known, such as other springs, elastic materials and mechanical elements can also be used. In the disengaged position, no toner release agent is transferred between the supply roller 46 and the fuser roller 44.

The SMA members 60 are selected to have a critical working temperature, $T_c$, corresponding to the temperature where toner particles begin to adhere to the fuser roller 44. The critical temperature $T_c$ is selected to be less than or equal to the binary activation temperature (i.e., the temperature where the SMA material reacts), $T_a$, of the SMA members 60. Thus, during operation of the image forming apparatus when the apparatus working temperature (i.e., the actual temperature of the SMA members 60), $T_w$, within the housing is less than the critical temperature, $T_c$, the SMA members 60 are in a relaxed state, and the downward forces $F_s$ bias the supply roller 46 into the disengaged position. However, when the apparatus working temperature, $T_w$, is at or about the critical temperature, $T_c$, the SMA members 60 are activated (i.e., they react or respond) and exert the forces $F_a$ on the supply roller 46 that overcome the downward forces $F_s$. As a result, the supply roller 46 is pulled into operable engagement with the fuser roller 44. Upon engagement, the supply roller 46 and the fuser roller 44 rotate about one another, and the supply roller 46 transfers the toner release agent to the fuser roller 44.

If the apparatus working temperature, $T_w$, thereafter falls below the critical temperature, $T_c$, for example during periods of apparatus 10 inactivity, the SMA members 60 return to their relaxed state, the forces $F_a$ go toward zero, and the downward forces $F_s$ bias the supply roller 46 away from the fuser roller 44.

The apparatus 10 may be configured as described above except that the supply roller 46 applies the toner release agent to the pressure roller 42, or to other rollers instead of, or in addition to, the fuser roller 44.

Figure 5:
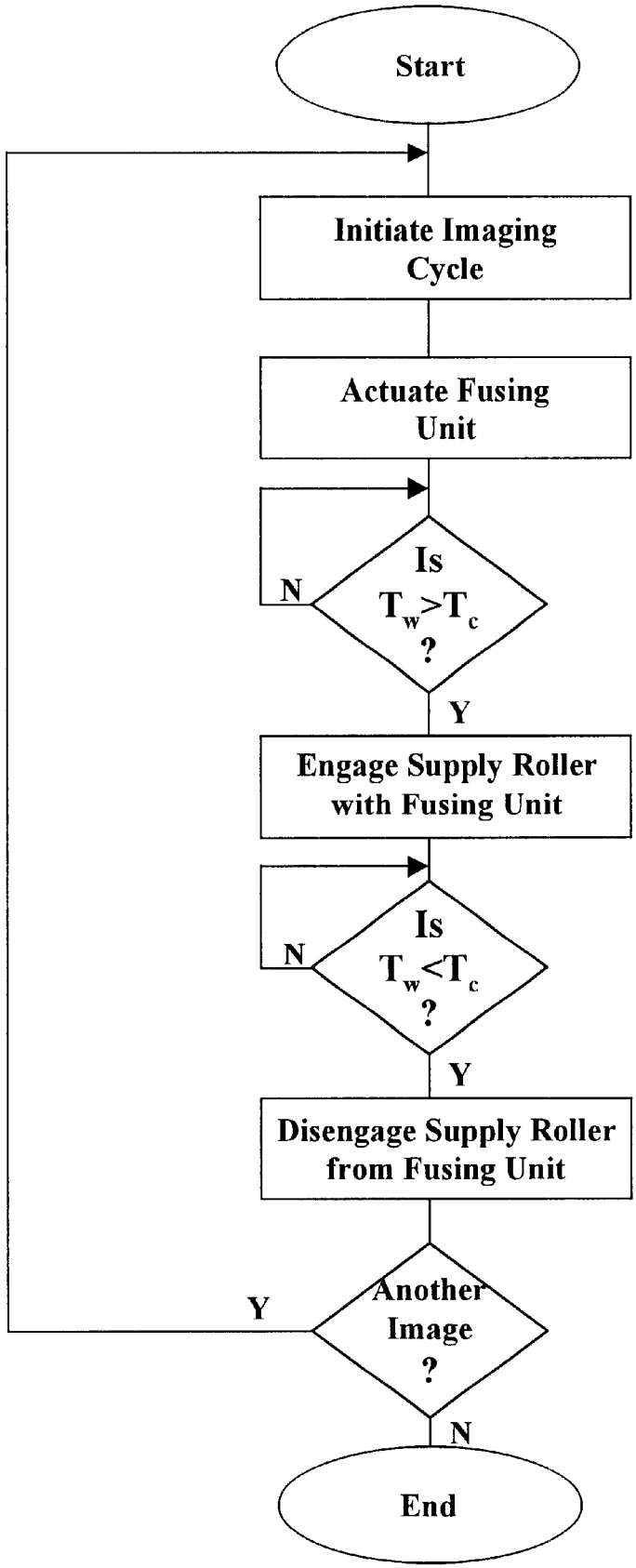
FIG. 5 is a flow diagram of a method to apply a toner release agent to an image forming apparatus.

The use of a thermally-activated actuator subassembly also allows for a method of applying a toner release agent in an image forming apparatus. As shown in FIG. 5, the method involves: (a) initiating an imaging cycle; (b) actuating a fusing unit; (c) furnishing a thermally-activated actuator to control operable engagement between the supply roller and the second roller; (c) configuring the actuator to engage the supply roller with the second roller when the working temperature $T_w$ is at (or above) a critical temperature, $T_c$, (i.e., the temperature where toner particles begin to adhere to the image forming apparatus); and (d) configuring the actuator to disengage the supply roller with the second roller when the working temperature $T_w$ is at (or below) the critical temperature, $T_c$. The imaging cycle continues so long as there are media substrates having toner images to fuse thereto.

Preferably, under this method the thermally-activated actuator subassembly is configured such that when the working temperature of the image forming apparatus is above the critical temperature, $T_c$, the supply roller engages the second roller, and when the working temperature of the image forming apparatus is below the critical temperature, $T_c$, the supply roller does not engage the second roller. For example, if the thermally-activated actuator comprises a shape memory alloy (SMA) wire, the configuring involves selecting the SMA wire with a binary activation temperature equal to or less than a critical working temperature (i.e., the temperature that toner images begin to adhere to the second roller, or to the image forming apparatus).

It should also be appreciated by one skilled in the art that the present invention may be embodied in connection with any imaging system which utilizes toner materials which are transferred to a substrate and subsequently fused thereto.

The use of the above-described imaging system allows for a method for printing toner images on a substrate such that all of said toner images adhere to said substrate. The method comprises: (a) charging a photoreceptor belt to a uniform charge to form a charged photoreceptor belt; (b) exposing the charged photoreceptor belt to an exposure unit to form a charged pattern on the photoreceptor belt; (c) developing the charged pattern into a physical image by adhering charged toner particles to the charged pattern to form a toner image; (d) transferring the toner image to the substrate; (e) fusing the charged toner particles to the substrate between a plurality of rollers; (f) providing a thermally-activated toner release agent subassembly for selectively applying a toner release agent to at least one of said rollers at a predetermined temperature; and (g) cleaning the photoreceptor belt to remove the uniform charge, charged pattern and the charged toner particles.

The foregoing description of the embodiments of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and modifications as are suited to the particular use contemplated. It is intended that the scope of the invention not be limited by the specification, but be defined by the claims set forth below.

What is claimed is:

1. An imaging system, comprising:

an imaging subsystem for forming a toner image on a substrate; and a fusing unit for fixing the toner image to the substrate, said fusing unit comprising a fuser roller for applying heat to the toner image at an operating temperature;

a supply roller moveable between an engaged position wherein the supply roller applies a toner release agent to the fuser roller and a disengaged position; and a thermally-activated actuator subassembly operably connected to the supply roller and configured to move the supply roller from the disengaged position to the engaged position when the fuser roller is above the operating temperature.

2. The system of claim 1, wherein the thermally-activated actuator subassembly includes a first shape memory alloy member operably attached to the supply roller, the first shape memory alloy member reacts when the temperature is above the operating temperature.

3. The system of claim 2 wherein the thermally-activated actuator subassembly further includes a spring attached to the supply roller biased to move the supply roller to the disengaged position when the temperature is sufficiently below the operating temperature.

4. The system of claim 2 wherein the thermally-activated actuator subassembly further includes at least a second shape memory alloy member operably attached to the supply roller to work in conjunction with the first shape memory alloy member when the temperature is above the operating temperature.

5. The system of claim 2 wherein the imaging system further includes a supportive housing having a slot, the supply roller being mounted to the supportive housing within the slot such that the supply roller can be freely moved along the slot.

6. The system of claim 5 wherein the thermally-activated actuator subassembly further includes at least a second shape memory alloy member operably attached to the supply roller to work in conjunction with the first shape memory alloy member when the temperature is above the operating temperature.

7. The system of claim 6 wherein the second shape memory alloy member comprises a wire and the first shape memory alloy member comprises a wire.

8. The system of claim 1, wherein said toner release agent comprises silicone oil.

9. A fusing unit for use in an image forming apparatus, said fusing unit comprising:

a fuser roller;

a supply roller moveable between an engaged position wherein the supply roller applies a toner release agent to the fuser roller and a disengaged position; and a thermally-activated actuator subassembly operably connected to the supply roller so as to move the supply roller from the disengaged position to the engaged position above a predetermined temperature.

10. The fusing unit of claim 9, wherein the thermally-activated actuator subassembly includes a first shape memory alloy member operably attached to the supply roller, the first shape memory alloy member reacts when the temperature is above the predetermined temperature.

11. The fusing unit of claim 10 wherein the thermally-activated actuator subassembly further includes a spring attached to the supply roller biased to move the supply roller to the disengaged position when the temperature is below the predetermined temperature.

12. The fusing unit of claim 10 wherein the thermally-activated actuator subassembly further includes at least a second shape memory alloy member operably attached to the supply roller to work in conjunction with the first shape memory alloy member when the temperature is above the predetermined temperature.

13. The fusing unit of claim 10 wherein the image forming apparatus further includes a supportive housing having a slot, the supply roller being mounted to the supportive housing within the slot such that the supply roller can be freely moved along the slot.

14. The fusing unit of claim 13 wherein the thermally-activated actuator subassembly further includes at least a second shape memory alloy member operably attached to the supply roller to work in conjunction with the first shape memory alloy member when the temperature is above the predetermined temperature.

15. The fusing unit of claim 14 wherein the second shape memory alloy member comprises a wire and the first shape memory alloy member comprises a wire.

16. The fusing unit of claim 9, wherein the toner release agent comprises silicone oil.

17. A toner release agent application assembly applying a toner release agent to a fuser in an image forming apparatus, said toner release agent application assembly comprising:

a supply roller moveable between an engaged position wherein the supply roller applies the toner release agent to a second roller and a disengaged position; and a thermally-activated actuator subassembly operably connected to the supply roller so as to move the supply roller from the disengaged position to the engaged position above a predetermined temperature.

18. The assembly of claim 17, wherein the thermally-activated actuator subassembly includes a first shape memory alloy member operably attached to the supply roller, the first shape memory alloy member constricts when the temperature is above the predetermined temperature.

19. The assembly of claim 18 wherein the thermally-activated actuator subassembly further includes a spring attached to the supply roller biased to move the supply roller to the disengaged position when the temperature is below the predetermined temperature.

20. The assembly of claim 18 wherein the thermally-activated actuator subassembly further includes at least a second shape memory alloy member operably attached to the supply roller to work in conjunction with the first shape memory alloy member when the temperature is above said predetermined temperature.

21. The assembly of claim 18 wherein the image forming apparatus further includes a supportive housing having a slot, the supply roller being mounted to the supportive housing within the slot such that the supply roller can be freely moved along the slot.

22. The assembly of claim 21 wherein the thermally-activated actuator subassembly further includes at least a second shape memory alloy member operably attached to the supply roller to work in conjunction with the first shape memory alloy member when the temperature is above the predetermined temperature.

23. The assembly of claim 22 wherein the second shape memory alloy member comprises a wire and the first shape memory alloy member comprises a wire.

24. The assembly of claim 17, wherein the toner release agent comprises silicone oil.

25. A method for supplying a toner release agent in an image forming apparatus comprising a supply roller and a second roller, the supply roller configured to transfer the toner release agent to the second roller, said method comprising:

coating the supply roller with the toner release agent;

engaging the supply roller with the second roller such that the toner release agent is transferred to the second roller upon the image forming apparatus having a temperature at or above a predetermined temperature; and disengaging the supply roller from the second roller upon the image forming apparatus having a temperature below the predetermined temperature.

26. The method according to claim 25, wherein the engaging and disengaging involves selecting a shape memory alloy member having a binary activation temperature at the predetermined temperature.

27. The method according to claim 26 wherein the engaging and disengaging further involve counter-biasing the shape memory alloy member.

* * * * *